United States Patent [19]

Yamada et al.

[11] 4,304,746

[45] Dec. 8, 1981

[54] PROCESS FOR PRODUCING PREOXIDIZED FIBER SPUN YARNS

[75] Inventors: Kozo Yamada; Takenobu Hasebe; Kazuhisa Saito, all of Shizuoka, Japan

[73] Assignee: Toho Beslon Co., Ltd., Tokyo, Japan

[21] Appl. No.: 214,164

[22] Filed: Dec. 8, 1980

[30] Foreign Application Priority Data

Dec. 8, 1979 [JP] Japan ..... 54-159469

[51] Int. Cl.[3] ..... D02G 1/20

[52] U.S. Cl. ..... 264/103; 8/115.5; 264/29.3; 264/168; 264/182; 264/210.3; 423/447.2

[58] Field of Search ..... 8/115.5; 57/254; 264/168, 136, 103, 210.3, 182, 29.2, 29.3; 423/447.1, 447.2

[56] References Cited

FOREIGN PATENT DOCUMENTS 52-31122 3/1977 Japan ..... 264/29.2

*Primary Examiner*—Jay H. Woo

*Attorney, Agent, or Firm*—Sughrue, Mion, Zinn, 2acpeak and Seas

[57] ABSTRACT

A process for producing preoxidized fiber spun yarns is described comprising subjecting an acrylonitrile fiber tow to a preoxidation, applying a surface active agent, stretch cutting without crimping, crimping to form slivers, processing in a gilling step, and spinning; according to this process, short fibers and powders of fibers are formed to a lesser extent, and nebs, slubs and flies, etc. are caused to a lesser extent, and preoxidized fiber spun yarns having high quality are obtained in a high yield.

13 Claims, No Drawings

PROCESS FOR PRODUCING PREOXIDIZED FIBER SPUN YARNS

BACKGROUND OF THE INVENTION

The present invention relates to a process for producing preoxidized fiber (flameproof fiber) spun yarns from acrylonitrile fiber tows.

It has been known that preoxidized fibers can be obtained by an oxidation treatment (flameproofing treatment) of acrylonitrile fiber bundles at from about 200° to 300° C. in an oxidizing atmosphere. They can be used as a precursor for carbon fibers (i.e., nonactivated carbon fibers having generally high mechanical strength, which are used as reinforcing materials) or activated carbon fibers or they can be used directly for uses utilizing heat resistance and flame resistance thereof.

In the case of producing spun yarns of carbon fibers or activated carbon fibers, a process comprising spinning of preoxidized fibers, and then processing in a carbonization step or an activation step has been adopted, because spinning becomes more difficult to carry out after carbonization or activation because of a lowering of the mechanical strength. Further, in the case of directly utilizing the preoxidized fibers, they are often used as spun yarns.

However, these preoxidized fibers are not crimped produced by conventional processes, and they have low elongation or low knot strength. Accordingly, they are very difficult to be processed in the spinning step after being processed in a crimping step. Particularly, in the case of using acrylonitrile fibers subjected to a preoxidation for uses other than carbon fibers, it is necessary to carry out a more violent (i.e., under a higher temperature and/or for a longer period of time) preoxidation than in the case of using for carbon fibers. That is, in the case wherein the preoxidized fibers as the precursor of activated carbon fibers are not sufficiently oxidized, the yield of the activated carbon fibers is low, and fibers having a large surface area are difficult to obtain. Further, in order to provide properties as heat resisting noncombustible materials, it is necessary to carry out a more violent preoxidation than is the case when using for carbon fibers. In this way, in the case of using as a precursor for preparing carbon fibers, the fibers can be subjected to the carbonization step even though they are in a combustible state.

In order to produce preoxidized fibers for activated carbon fibers or a provide heat resistance or flame resistance to such fibers, it is necessary that the oxidation treatment be carried out until the specific gravity of the fibers is from about 1.35 to 1.45 or so, under which conditions further spinning is difficult to carry out. The fibers subjected to the oxidation treatment as described above can be of course processed in the carbonization step.

Hitherto, a process for producing spun yarns of preoxidized fibers has been proposed in Japanese Patent Application (OPI)-3112/77. (The term "OPT" as used herein refers to a "published unexamined Japanese patent application".) According to this process, the spun yarns are obtained from acrylonitrile filament bundles (composed of 1000–16000 filaments) by a process comprising the steps of preoxidation, steam thermal crimping, stretch cutting, combing, gilling, and roving, or steps of comprising preoxidation, steam thermal crimping, and production of slivers by stretch cutting.

According to such a process, however, since the steam thermal crimping is carried out before stretch cutting, the fibers are damaged in the steam thermal crimping step, and short fibers or powders of fibers are formed during the stretch cutting step, to cause neps or slubs when produced spun yarns. Consequently, combing is necessary to carry out to remove neps and slubs. Further, a number of flies is caused (i.e., the fiber becomes to powder and scatters) during the steps, to lower the yield of yarn. Moreover, spun yarns having high quality are difficult to obtain by such a process.

SUMMARY OF THE INVENTION

An object of the present invention is to provide a process for spinning preoxidized fibers obtained from acrylonitrile filaments.

A further object of the present invention is to obtain spun yarns-having high quality in a high yield with less formation of short fibers or powders of fibers and less causing neps, slubs and flies.

Therefore, in accordance with the present invention, there is provided a process for producing preoxidized fiber spun yarns comprising subjecting an acrylonitrile fiber tow to a preoxidation in an oxidizing atmosphere, applying a surface active agent, stretch cutting without crimping, crimping to form slivers, processing in a gilling step, and spinning.

DETAILED DESCRIPTION OF THE INVENTION

In the present invention, an acrylonitrile fiber tow refers to a group of fibers composed generally of a polymer or a copolymer comprising at least 60% by weight acrylonitrile. Examples of comonomers that can be used therewith include vinyl type unsaturated compounds polymerizable with acrylonitrile, for example, acrylic acid, methacrylic acid, allylsulfonic acid, methallylsulfonic acid and itaconic acid or salts and esters thereof, acrylamide, etc. Further, fiber tows obtained from a polymer mixture composed of the above described polymer or copolymer and other acrylonitrile copolymers may also be used. In the case wherein the resulting product is to be used for producing activated carbon fibers, polymers having a high comonomer content can be used. In the case of producing carbon fibers, polymers having a low comonomer content are preferably used. Generally, polymers comprising less than 40% by weight, preferably from 8 to 20% by weight, and most preferably from 10 to 15% by weight, of comonomers are used as the polymers for producing activated carbon fibers; polymers comprising less than 5% by weight, and preferably less than 3% by weight, of comonomers are used as the polymers for producing carbon fibers; and polymers comprising from 2 to 10% by weight, but preferably less than 5% by weight, of comonomers are used as the polymers for producing preoxidized fibers.

If the content of comonomer is more than 20%, the surface significantly softens, generally, in the oxidation treatment (flameproofing treatment), to easily cause adhesion. Further, the oxidation treatment becomes difficult to carry out, because of cutting resulting from combustion, and the spinning ability deteriorates. In such cases, therefore, it is preferred to carry out an adhesion preventing treatment, such as addition of iron salts to the acrylonitrile polymer.

In order to produce fiber tows from the acrylonitrile polymers, although various organic solvents can be used, residual organic solvent in the fibers sometimes cause fragility of fibers (decrease of mechanical strength of fibers) in the preoxidation. Therefore, it is preferred to use inorganic solvents as the solvent. Particularly, in the case of using a concentrated aqueous solution of zinc chloride, oxidation time is shortened by residual zinc in the fibers, heat resistance of the product is improved, and the yield of the activated carbon fiber is improved in case of activating. The denier of the acrylonitrile fibers is generally from 0.7 to 5 deniers, and preferably from 1 to 3 deniers.

The oxidation treatment is usually carried out under tension in an oxidizing atmosphere, generally air, at from about 200° C. to 300° C. The coefficient of contraction of fibers in the oxidation treatment is from 40 to 90% based on the coefficient of free contraction at the same temperature. It is particularly preferred that the coefficient of contraction is from 50 to 90% in the case of using the fibers in a state of preoxidation fibers, from 50 to 90% in case of using as activated carbon fibers (Japanese Patent Application (OPI) 45426/1978 and British Pat. No. 1,549,759 and German Pat. No. 2,715,486), and from 40 to 70% in the case of using as carbon fibers (U.S. Pat. No. 4,069,297).

The tows preferred to be treated are those having a denier of from 200,000 to 1,000,000 deniers, and preferably from 350,000 to 850,000 deniers, and they are processed directly in the spinning step, because fibers are effectively collected (easy in handling without disorganization) as tows. In the case when the tows to be treated have high deniers of as large as 1,000,000, they are sometimes preferred to be treated as two parts, of 50,000 deniers each.

The acrylonitrile fibers, which typically have a specific gravity of about 1.17 or so, become dense as the oxidation treatment progresses. If the specific gravity becomes higher than 1.30, it becomes possible to introduce the fibers into a carbonization step. However, the oxidation treatment of giving 1.30 of the specific gravity brings low heat resistance and low flame resistance (though elasticity is excellent). Accordingly, the fibers obtained are not suitable for uses utilizing them directly or for producing activated carbon fibers. Thus, the oxidation treatment is more preferably carried out until the specific gravity is from about 1.35 to 1.45. It is of course possible to use preoxidized fibers subjected to the oxidation treatment of such degree for the carbonization step, too. If the specific gravity of the fibers becomes higher than 1.45, knot elongation and knot strength are remarkably low and it is hardly possible to carry out the spinning operation. The time required for the oxidation treatment is usually from 30 minutes to 20 hours. The present invention is especially effective for spinning fibers having 1.35 or more of the specific gravity and low mechanical strength.

The preoxidized fiber tows subjected to the oxidation treatment as described above have low elongation properties and are brittle. Consequently, they can not be directly introduced into the conventional spinning step. Thus, a surface active agent is applied to the preoxidized fiber tows. In the present invention, the surface active agent which is conventionally used as an untistatic agent of a fiber can be used. As the surface active agent, a mixture of a nonionic surface active agent and a weakly anionic surface active agent is preferably used.

Examples of the weakly anionic surface active agent include, for example, salts of higher alkyl phosphoric acid esters. The nonionic surface active agents include, for example, amide type or ester type surface active agents of polyoxy compounds and polyethylene oxide type surface active agents.

The surface active agent can be applied by dipping the tows in an aqueous dispersion or an aqueous solution thereof and drying thereafter. The concentration of the dispersion or the solution is generally from 1 to 4% by weight and, preferably, from 1.4 to 2.8% by weight. Usually, the surface active agent is applied in an amount of from 0.3 to 1.2% by weight, and preferably from 0.4 to 0.8% by weight, based on the weight of preoxidized fibers before application thereof. The drying is carried out at the temperature of below about 120° C., until the water content becomes from 7.5 to 14% by weight, and preferably from 8 to 12% by weight based on the weight of fibers containing the surface active agent.

If the amount of the surface active agent is less than about 0.3% by weight, generally, the sliver swells to cause coiling round rollers due to generation of static electricity. Further, slivers become disorganized in the can (slivers are entangled and/or adhere to the inner wall of the can) and cutting of slivers is easily caused by a creel. On the other hand, if the amount of the surface active agent exceeds about 1.2% by weight, the surface active agent and the fiber powder fallen off accumulate on the roller to form adhesive scums, by which coiling of fibers is caused.

As the surface active agent, the above described mixture is preferably used. If a cationic surface active agent or only the weakly anionic surface active agent is used, spinning is difficult to carry out because of tendencies of coiling round rubber rollers or generation of static electricity.

Tows obtained as described above can be processed directly in the spinning step without subjecting them to steam thermal crimping, because they effectively collect as fiber bundles. In addition, since the fibers are not processed while being in state of a tow material in the crimping step, they are not damaged, and spun yarns having high filament strength can be obtained in a high yield.

The tows to which the surface active agent was applied are processed by a stretch cutting apparatus. As the stretch cutting apparatus, a roller press type stretch cutter is used. It is preferred that the cutting be carried out so as to obtain bias-cut of from 60 to 100 mm of the average fiber length, and from 130 to 170 mm of the maximum length. Further, it is preferred that the stretch cutting is carried out at 3 or more steps so as not to cut all of the fibers of the tow or fleeces in the same position and in the same length. Stretch ratios in stretch cutting of 3 steps are nearly equal one another so that the cutting is completely carried out little by little, namely in the range of from 1.3 to 1.9 of the stretch ratio. The stretch cutting may be carried out at 5 steps. After carrying out the stretch cutting, they are crimped to produce slivers. The crimping ratio is generally from 5 to 10%, and preferably from 8 to 10%, and the number of crimps is from 5 to 10/25 mm, and preferably from 7 to 10/25 mm.

The crimping ratio and the number of crimping are determined according on JIS (Japanese Industrial Standard) L-1074, wherein they are defined as follows:

$$\text{Crimping ratio (\%)} = \frac{b-a}{b} \times 100$$

a: the length of a fiber measured immediately after charging of 2 mmg/denier of load.

b: the length of the fiber measured after charging of 50 mmg/denier of load for 30 seconds.

Number of crimps: A fiber having 25 mm of length (which is measured immediately after charging of 2 mmg/denier of load) is placed on a plane plate and the number of tops (peaks) of crimps in both sides of the fiber on the plate are counted. A half of the number of tops is defined as the number of crimps.

The crimping is carried out, for example, by pressing the tows after stretch cutting in to a crimper box.

These slivers are then subjected twice or more to doubling and drafting in the gilling step to increase the degree of parallel fibers, by which slivers having a suitable weight per unit length for processing in the fine spinning step are obtained. This is generally from 0.8 to 6 g/m. The slivers after being processed in the gilling step are twisted with drafting by means of a spinning frame without subjecting to roving step. It is generally preferred that the apron draft is from 15 to 30 times and the spinning count (metric count) is 1/5–1/36. The coefficient of twisting is generally 75–95 (coefficient of twisting $K = \frac{T}{\sqrt{N}}$ wherein T is the number of twists per meter and N is the spinning count).

According to the process of the present invention it is possible to smoothly obtain spun yarns with less forming flies, even if a sufficient preoxidation is carried out. The spun yarns or woven or knitted fabrics composed of these spun yarns have sufficient heat resistance and flame resistance, and they can be used for producing activated carbon fiber fabrics. Further, they can also be used for producing carbon fiber products having good quality.

Particularly, since the fibers are not processed in the steam thermal crimping step, fibers are less damaged as compared with those of prior processes, and thus spun yarns having high quality are obtained. Moreover, in the process of the present invention, when a tow having a thickness of from 200,000 to 1,000,000 deniers subjected to the preoxidation are used, an excellent spinning property is obtained, because such tows are easy in handling and disorganization of fibers can be prevented.

The spun yarns obtained by the process of the present invention can be used for weaving and knitting as single yarns, but they are generally used after two folded yarns were produced. The woven or knitted fabrics can be used as heat resisting flameproof sheets, thermal work clothes prepared by laminating with a metal foil, and flameproof curtains, or they can be processed in steps for carbonization or activation, etc.

In the following, an example is illustrated.

EXAMPLE

An acrylonitrile fiber tow of 390,000 deniers (fibers composed of copolymer comprising 97% by weight of acrylonitrile and 3% by weight of methyl acrylate, denier of single yarn: 1.5 deniers, 260,000 monofilaments) were subjected to a preoxidation under tension in the air at 250° for 150 minutes (to give 60% of the contraction based on the coefficient of free contraction) to obtain preoxidized fibers having 1.40 of the specific gravity. These preoxidized fibers had sufficient flame resistance, which did not burn even if a flame was allowed to come near them. The preoxidized tows were dipped in a 2.2 wt.% aqueous solution of a surface active agent mixture prepared by mixing a polyethylene oxide type nonionic surface active agent and a weakly anionic surface active agent composed of salt of higher alkylphosphoric acid ester in the mixing ratio of 1:1 (weight) and dried until the water content became 9%, by which 0.6% by weight of the surface active agent was incorporated in the fibers.

After these tows were cut by 3 step stretch cutting in the stretch ratio of 1.5, 1.6 and 1.8, respectively, they were crimped so as to have a number of crimps of 8/25 mm, and a crimping ratio of 10% to produce slivers having 15 g/m of the weight. 4 of these slivers were put together and subjected twice to an operation of drawing 10 times in the gilling step. They were then processed in the fine spinning step. In the fine spinning step, the spinning was carried out so as to be 30 times of the stretch ratio, 288/m of the number of twists (coefficient of twisting: 86) and 1/11.3 of the metric count.

Preoxidized fiber staples subjected to the 3 step stretch cutting were bias-cut at 90 mm average fiber length, and 160 mm maximum fiber length, which were suitable lengthy for carding type spinning of long fibers. Breaking of yarns in the fine spinning step was 20/1000 spindles per 1 hour, and the spinning was smoothly carried out.

The resulted spun yarns had about 950 g of yarn strength and about 10% of yarn elongation. Further, 2 of these single yarns were twisted at S177/m of the number of twists to produce a two plied yarn. This two plied yarn was homogeneous, which had about 2,000 g of the yarn strength and 10.5% of the yarn elongation.

While the invention has been described in detail and with reference to specific embodiments thereof, it will be apparent to one skilled in the art that various changes and modifications can be made therein without departing from the spirit and scope thereof.

What is claimed is:

1. A process for producing preoxidized fiber spun yarns comprising subjecting an acrylonitrile fiber tow to a preoxidation, applying a surface active agent, stretch cutting without crimping, crimping to form slivers, processing in a gilling step, and spinning.

2. A process for producing preoxidized fiber spun yarns according to claim 1 wherein the tow has a denier of from 200,000 to 1,000,000 deniers.

3. A process for producing preoxidized fiber spun yarns according to claim 1, wherein the acrylonitrile fibers have a denier of from 0.7 to 5 deniers.

4. A process for producing preoxidized fiber spun yarns according to claim 1, wherein the temperature of the preoxidation is from 200° C. to 300° C. and the period of treatment is from 0.5 to 20 hours.

5. A process for producing preoxidized fiber spun yarns according to claim 1, wherein the preoxidation is carried out until the specific gravity of the fibers becomes at least 1.30.

6. A process for producing preoxidized fiber spun yarns according to claim 1, wherein the preoxidation is carried out until the specific gravity of the fibers is from about 1.35 to 1.45.

7. A process for producing preoxidized fiber spun yarns according to claim 1, wherein the surface active agent is a mixture of a nonionic surface active agent and a weakly anionic surface active agent.

8. A process for producing preoxidized fiber spun yarns according to claim 1 or 7 wherein the amount of surface active agent is from 0.3 to 1.2% by weight based on the weight of fibers before application of the surface active agent.

9. A process for producing preoxidized fiber spun yarns according to claim 1 comprising carrying out at least 3 steps of stretch cutting.

10. A process for producing preoxidized fiber spun yarns according to claim 1, wherein the stretch ratio of stretch cutting is from 1.3 to 1.9.

11. A process for producing preoxidized fiber spun yarns according to claim 1 wherein the fibers after stretch cutting are bias-cut of from 60 to 100 mm average fiber length and from 130 to 170 mm maximum length.

12. A process for producing preoxidized fiber spun yarns according to claim 1, wherein the crimping is carried out so that the crimping ratio is from 5 to 10% and the number of crimps is from 5 to 10/25 mm.

13. A process for producing preoxidized fiber spun yarns according to claim 1, wherein after processing in the gilling step the slivers are introduced directly to the spinning.

* * * * *